United States Patent [19]

Takeda et al.

[11] Patent Number: 4,475,058

[45] Date of Patent: Oct. 2, 1984

[54] DISCHARGE LAMP HAVING CONVOLUTED DISCHARGE PATH

[75] Inventors: Takao Takeda, Chigasaki; Hiroshi Ito, Tokyo; Hitoshi Yamazaki, Yokohama; Atsushi Hattori, Kanagawa; Seiichiro Yamamoto, Kamakura; Jun Imai, Hiratsuka, all of Japan

[73] Assignee: Mitsubishi Denki Kabushiki Kaisha, Tokyo, Japan

[21] Appl. No.: 320,117

[22] Filed: Nov. 10, 1981

[30] Foreign Application Priority Data

Nov. 17, 1980 [JP] Japan ..... 55-161796

[51] Int. Cl.[3] ..... H01J 61/10; H01J 61/88

[52] U.S. Cl. ..... 313/493; 313/610

[58] Field of Search ..... 313/609 (U.S. only), 313/610 (U.S. only), 634 (U.S. only), 611(U.S. only), 612 (U.S. only), 613 (U.S. only), 491, 313/485, 493, 573

[56] References Cited

U.S. PATENT DOCUMENTS

| | | | |
|---|---|---|---|
| 3,849,689 | 11/1974 | Campbell | 313/610 X |
| 4,208,618 | 6/1980 | Heine | 313/573 X |
| 4,281,271 | 7/1981 | Young et al. | 313/493 |
| 4,401,914 | 8/1983 | Wesselink et al. | 313/610 |

*Primary Examiner*—Palmer C. Demeo
*Assistant Examiner*—Sandra L. O'Shea
*Attorney, Agent, or Firm*—Wenderoth, Lind & Ponack

[57] ABSTRACT

A discharge lamp having a discharge path-defining member which so defines the discharge path in the bulb that it runs in a convoluted manner with interlinked passages running between the top and the bottom of the bulb, wherein the top portion of the discharge path-defining member is provided with a top plate which permits one of the curved passage-interlinking portions at the bulb top to pass along the upper surface thereof, such that the shadow of the discharge path-defining member is eliminated from the bulb top and that the shape of the bulb can be freely selected, also enabling the lamp to be designed such that it is not easily broken, the discharge path-defining member can be easily and intimately fitted, and that the output of light is not reduced in the bulb top region.

15 Claims, 14 Drawing Figures

DISCHARGE LAMP HAVING CONVOLUTED DISCHARGE PATH

BACKGROUND OF THE INVENTION

1. Field of the Invention

The present invention relates to a discharge lamp having a discharge path-defining member which defines the discharge path in the bulb as a convoluted path with an interlinked section running between the top and the bottom of the bulb.

2. Description of the Prior Art

In recent years, a number of small fluorescent lamps have been proposed which feature the merits (high efficiency, long life) of discharge lamps such as fluorescent lamps, and which are compact in size and which can therefore be enployed in locations in which typically incandescent lamps have been used.

FIG. 1 shows an example in which a pair of electrodes 15*a*, 15*b* are provided in an opposed manner on one side of a cylindrical bulb 1 made of a glass, and the discharge path established between the electrodes 15*a* and 15*b* is caused to run in a convoluted manner with an interlinked passage running between the top and bottom of the bulb 1 by a discharge path-defining member 5 which is formed substantially in the shape of a cross.

Unless the discharge path-defining member 5 makes positive contact with the inner surface of the bulb 1, however, discharging may take place between adjacent sections of the discharge path, making it difficult to obtain a discharge path which follows the desired convoluted path. It is particularly difficult for the discharge path-defining member 5 to make positive contact with the bulb 1 at the top portion 3 of the bulb 1. Therefore, bulbs in which the top 3 is flat such that it comes into contact with the upper end of the discharge path-defining member 5 as shown in FIG. 1, have been tried, and, as shown in FIG. 2, forming one of the plates of the discharge path-defining member such that its top 9 makes positive contact with the inner surface of the top 3 of the bulb, which is formed in the shape of a dome, has also been tried. With the former bulb of FIG. 1, however, the circumferential edge of the flat plane of bulb 1 tends to be thick which makes it difficult for the discharge path-defining member to make intimate contact therewith. Further, residual stresses in the thickened portions are a frequent cause of breakage during and after production.

Moreover, the end 9 of the discharge path-defining member 5 forms a shadow on the flat plane, and the flat top 3 gives the bulb a poor external appearance.

With the latter bulb shown in FIG. 2, on the other hand, the top 3 of the bulb is formed in a dome shape, and less of a shadow is formed by the top 9 of the discharge path-defining member 5. Further the appearance is better than that of the former bulb. However, it is very difficult to make the top 9 of the discharge pathdefining member 5 positively contact the inner surface at the top 3 of the bulb because of imperfection in the shape of dome. Therefore, it is difficult to industrially produce the bulbs.

In view of the above-mentioned circumstances, therefore, a bulb has been proposed as shown in FIG. 3, which maintains the shape of a dome, which eliminates the need for bringing the discharge path-defining member 5 into contact with the curved dome portion, and which has an industrially desirable appearance. That is, a circular top plate 12 that comes into contact with the inner circumference of the bulb 1 is attached to the top 9 of the discharge path-defining member 5 which has the same shape as that of FIG. 1. Even if the top plate 12 is made of a light-transmitting material, however, ultraviolet rays produced by the discharge are reduced by the top plate 12, and only a small amount of light is emitted in the dome-shaped portion, since the discharge passes beneath the top plate 12. This means that when the lamp is mounted with its base 18 upwards, the area directly under the lamp is poorly illuminated. In other words, there are limitations on the use of the lamp.

SUMMARY OF THE INVENTION

The object of the present invention is to provide a discharge lamp having a discharge path-defining member which so defines the discharge path in the bulb that it runs in a convoluted manner with interlinked passages running between the top and the bottom of the bulb, wherein the top portion of the discharge path-defining member is provided with a top plate which allows the discharge path to pass from one side passage to another via a curved portion inside the domed top of the bulb, such that there is no shadow of the discharge path-defining member on the bulb top and the shape of the bulb can be freely selected. Further, this construction means that the lamp is not easily broken, the discharge path-defining member can be provided easily with positive contact, and the output of light is not reduced in the bulb top.

Another object of the present invention is to provide a discharge lamp in which the top of a discharge path-defining member which divides the space inside the bulb into six sections is provided with a top plate which has cut-away portions to connect the two chambers of the divided space' a seventh space chamber being formed by the top plate, with a pair of electrodes disposed in opposing space chambers, such that the bulb can be easily manufactured, the light output toward the top of the bulb is increased, and fewer limitations are imposed on the use of the bulb.

A further object of the present invention is to provide a discharge lamp in which the bulb is provided with a projection that comes into contact with contacting portions of the discharge path-defining member in order to prevent the formation of a gap between the top of the discharge path-defining member and the inner surface of the bulb even when the true circularity of the bulb is slightly less than perfect, such that a predetermined discharge path is reliably formed.

Still a further object of the present invention is to provide a discharge lamp in which engaging grooves of which the depth gradually decreases toward the end of the bulb are formed in the inner surface of the bulb, the discharge path-defining member being provided with side portions of a shape that fits to the engaging grooves, so that the layer of a fluorescent material is prevented from being peeled off by the side portions when the discharge path-defining member is inserted and so that very little shadow is formed by the side portions.

Yet another object of the present invention is to provide a discharge lamp in which the bulb is composed of a small-diameter portion having engaging grooves with which the side portions of the discharge path-defining member engage, and a large-diameter portion which is contiguous with the small-diameter portion and of which the ends of the engaging grooves on the side of the bottom of the bulb are exposed, such that a stem can be enclosed in the large-diameter portion to simplify the operation for enclosing the stem in the bulb.

A further object of the present invention is to provide a discharge lamp in which a projection is formed in the bulb to protrude toward the inner side thereof, engaging grooves being formed which protrude outwardly from the inner surface of the bulb and of which the depth gradually increases from the lower surface of the projection toward the bottom of the bulb, the discharge path-defining member being so formed that its width expands to correspond to that of the engaging grooves, the side portions being closely fitted to the engaging grooves of the bulb under the condition in which the peripheral edge of the top plate is brought into contact with the lower surface of the projection, in order to prevent the formation of a gap between the top of the discharge path-defining member and the inner surface of the bulb even when the true circularity of the bulb is slightly diminished, such that a desired discharge path is reliably formed, the layer of the fluorescent material is prevented from being peeled off by the side portions when the discharge path-defining member is inserted, very little shadow is formed by the discharge path-defining member, and the appearance is improved.

DESCRIPTION OF THE PREFERRED EMBODIMENTS

Figure 4:
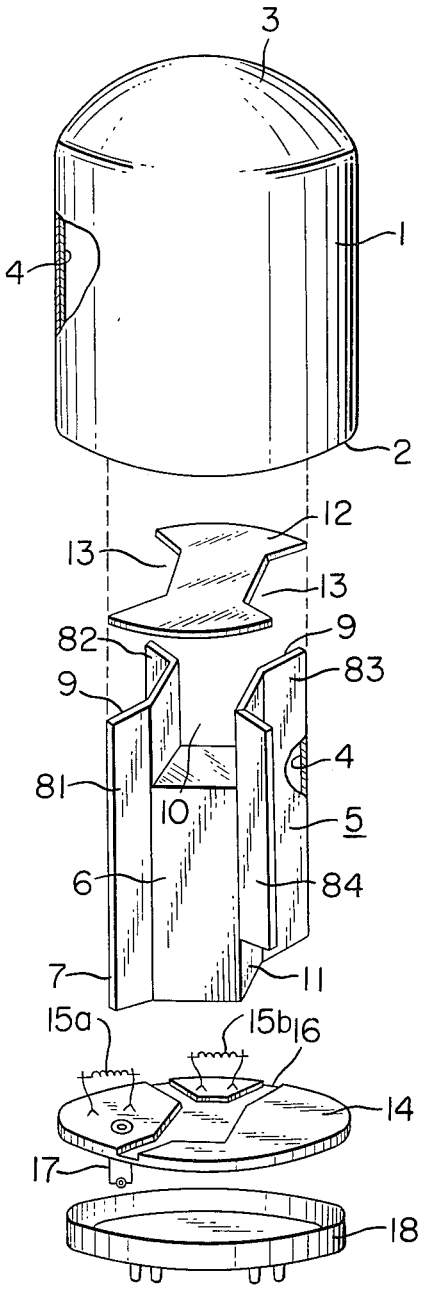
FIG. 4 is an exploded perspective view showing, a discharge lamp according to an embodiment of the present invention.

A first embodiment of the present invention will be described below with reference to FIG. 4, in which cylindrical glass bulb 1 with an open bottom 2 and a dome-shaped top 3 has a fluorescent layer 4 adhered to the inner surface of the bulb 1, and a discharge path-defining member 5 made of nickel sheet is contained inside the bulb 1. The discharge path-defining member 5 consists of a pole-like core 6 of which the cross section is substantially square, and four wings 81 to 84 having side portions 7' that protrude radially from the corners of the core 6 so as to contact the inner surface of the bulb 1. A discharge guide hole 10 is formed by cutting away the core 6 to connect the opposing discharge paths at the top 9 of the discharge path-defining member 5, while a lower discharge guide hole 11 is formed by cutting away the lower end of the wing 84, and a circular top plate 12 made of nickel sheet is attached to the top 9 of the discharge path-defining member 5. The top plate 12 has a circumference of a shape and size that fits the inner peripheral surface of the bulb 1, and provided in the plate 12 are cut-away portions 13 which correspond to opposing discharge paths that meet at right angles with the discharge guide hole 10 of the discharge path-defining member 5. The surfaces of the discharge path-defining member 5 and the top plate 12 are coated with the fluorescent layer 4. On a glass stem 14 are studded a pair of electrodes **15*a*, 15*b*. The stem 14 is fitted to the bottom 2 of the bulb 1 so that one electrode 15*a* is located at a position to face one of the cut-away portions 13 of the top plate 12, and another electrode 15*b* is positioned under the top plate 12 on the opposite side in the lower guide hole 11. A groove 16 is formed in the upper surface of the stem 14 which corresponds in shape to the lower end of the discharge path-defining member 5, an exhaust pipe 17 is provided in the stem 14, and base cap 18 is attached to the bottom of the stem 14**.

Below discussion is provided as to the manufacture of a fluorescent lamp according to the first embodiment. Prior to applying the fluorescent layer 4 to the interior of the bulb 1, the discharge path-defining member 5 is inserted into the bulb with the top plate 12 attached to the top 9 thereof. Then, a liquid containing a fluorescent material is poured into the bulb 1, so that the inner surface of the bulb 1, the surface of the discharge pathdefining member 5 and the surface of the top plate 12 are coated with the fluorescent layer 4. Thereafter, the stem 14 is fitted to the bottom 2 of the bulb such that the electrodes **15*a*, 15*b* are located at predetermined positions. Then, an electron-emitting substance (not shown) applied to the electrodes 15*a*, 15*b* is heated and decomposed while the impurity gases are expelled from the bulb 1. Thereafter, predetermined amounts of rare gas and mercury gas are introduced, the exhaust pipe 17 is closed and, finally, the cap 18** is attached.

Figure 5:
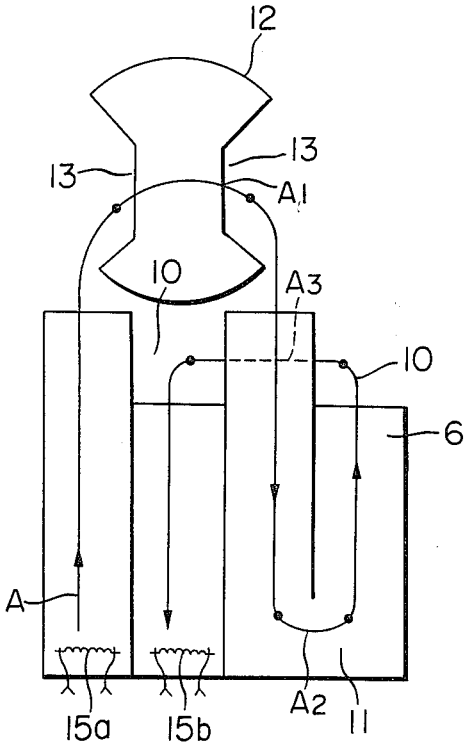
FIG. 5 is an expanded view illustrating the discharge path.

In the fluorescent lamp thus constructed, the discharge path-defining member 5 and the top plate 12 form the discharge path in the following way. The discharge path mentioned below follows the direction of arrows in FIG. 5, based on an assumption that the discharge path starts from the electrode on one side. A bent portion $A_1$ in the top of the bulb in a discharge path A starting from the electrode **15*a* through one cut-away portion 13 of the top plate 12, is contiguous with the lower discharge guide hole 11 through the upper surface of the top plate 12 and the cut-away portion 13. The discharge path A contiguous with the lower discharge guide hole 11 forms a bent portion $A_2$ on the lower side of the bulb and further forms a bent portion $A_3$ on the top side of the bulb while it stretches toward the discharge guide hole 10. The bent portion $A_3$ on the top side of the bulb passes through the discharge guide hole 10 and toward the other electrode 15*b*. Therefore, since there is no need to restrict the discharge path A on the top plate 12, there is no need to bring the discharge path-defining member 5 and the top plate 12 into contact with the top portion 3 of the bulb. Accordingly, such members do not form a shadow in the top portion 3 of the bulb. Further, the top 3 of the bulb 1 can be formed in the shape of a dome for a good appearance. The top plate 12 must contact the periphery on the inner side of the bulb 1 which can be formed maintaining precise dimensions. Hence the top plate 12 can contact the bulb 1 without forming any gap. Since there is no need to flatten the top portion 3 of the bulb, there are no thickened portions, making fitting easy. Moreover, residual stresses are eliminated reducing the risk of breakage both during and after production. Furthermore, since the bent portion $A_1$ in the discharge path A on the top side of the bulb passes over the top plate 12, more light is emitted from the top 3 of the bulb 1 in FIG. 4 than from the bulbs shown in FIGS. 1 and 2**.

Figure 1:
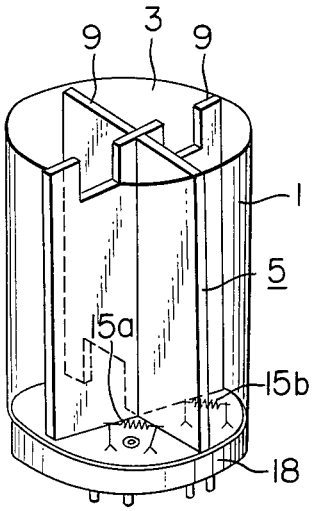
FIG. 1 PRIOR ART
FIGS. 1 to 3 are perspective views schematically illustrating conventional discharge lamps provided with discharge path-defining members.
Figure 2:
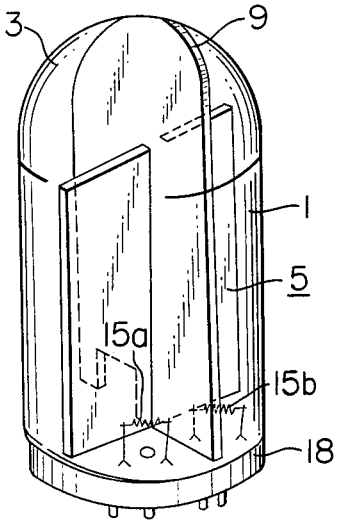
FIG. 2 PRIOR ART
Figure 3:
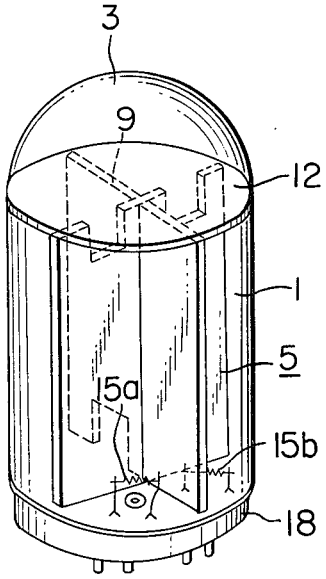
FIG. 3 PRIOR ART

Namely, in the bulbs shown in FIGS. 1 and 2, the two bent portions of the discharge path pass through the top portion 3. According to the above-mentioned embodiment of the present invention, however, the top plate 12 also works as a plane to emit the light. Therefore, the top portion 3 of the bulb containing only a single bent portion $A_1$ produces light in an amount comparable with conventional lamps. Also, since the discharge path A has two bent portions $A_1$ $A_3$ in the top portion 3 of the bulb like those of the above conventional bulbs, the total length is the same as that of the conventional bulbs, and the total efficiency of the lamp is not decreased.

Figure 6:
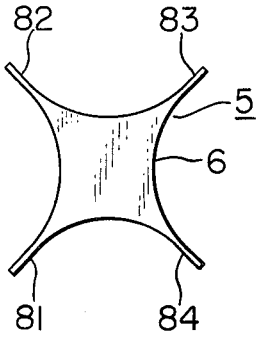
FIG. 6 is a sectional view of the discharge path-defining member according to another embodiment of the present invention.

According to the first embodiment, a square cylindrical core 6 is provided in the discharge path-defining member 5, making it easy to form the discharge guide hole 10. However, further efficiency can be achieved if the discharge path A is brought closer to the walls in the bulb. The shape of the core 6 is not of necessity limited to a square, and may be of a polygonal or circular section. The discharge path-defining member 5 and the top plate 12 may also be formed as a unitary structure. When the surfaces of the discharge path-defining member 5 are to be coated with the fluorescent layer 4 to form light-emitting surfaces or light-reflecting surfaces, greater light emission efficiency can be achieved if the core is formed with parabolic surfaces as shown in FIG. 6. Unlike the fluorescent layer 4 formed on the inner surface of the bulb 1, the fluorescent layer 4 formed on the discharge path-defining member 5 and the top plate 12 does not need to permit the passage of light. That is to say, the fluorescent layer 4 should be formed for maximum absorption of ultraviolet rays. In other words, the relation between the thickness $T_1$ of the fluorescent layer 4 on the bulb 1 and the thickness $T_2$ of the fluorescent layer 4 formed on the discharge path-defining member 5 and on the top plate 12, may be $T_1 < T_2$ to enhance the efficiency of the lamp.

If the bent portion $A_1$ in the top portion of the bulb passing over the top plate 12 in the discharge path A is permitted to run through the center of the top portion 3 of the bulb, advantages will be obtained in respect of light distribution and appearance.

Figure 7:
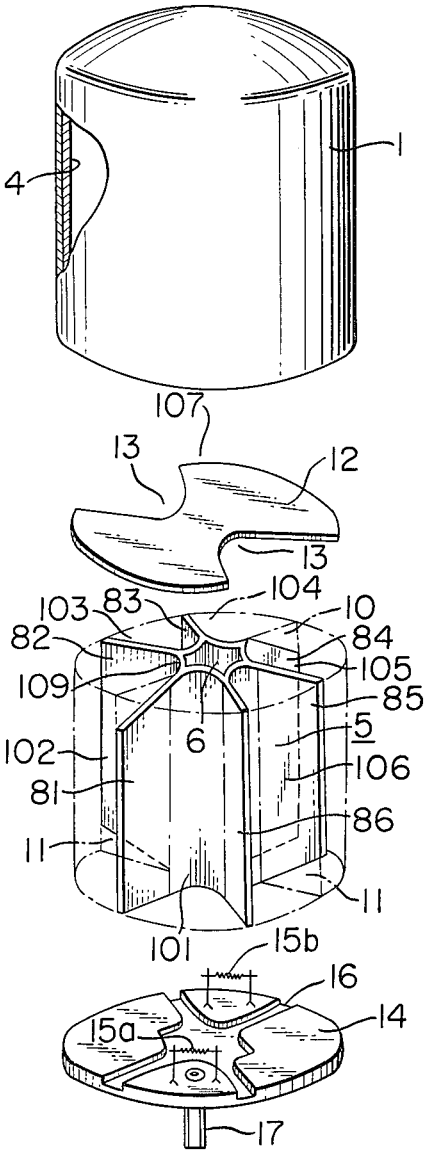
FIG. 7 is an exploded perspective view showing a further embodiment of the present invention.
Figure 8:
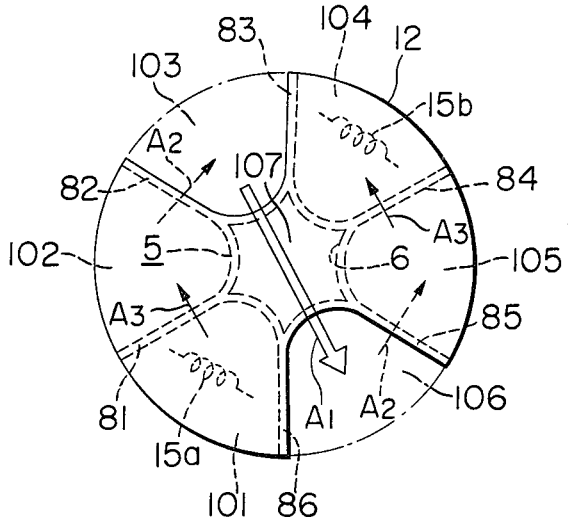
FIG. 8 is a diagram showing the discharge path of the discharge lamp of FIG. 7.

Below a second embodiment is described with reference to FIGS. 7 and 8, in which like numerals denote like or corresponding parts. In FIGS. 7 and 8, a discharge path-defining member 5 made of metal sheet is inserted into the bulb 1 and divides the space within the bulb 1 into six sections. The discharge path-defining member 5 consists of first to sixth wings 81 to 86 that protrude radially outwardly from the core 6 and contact the inner wall surface of the bulb 1, to form six space chambers 101 through 106 as counted in the clockwise direction. The first wing 81 and the fourth wing 84 have discharge guide holes 10 formed in the upper portions thereof, and the second wing 82 and the fifth wing 85 have lower discharge guide holes 11 formed in the lower portions thereof. A top plate 12 made of metal sheet has cut-away portions 13 at places corresponding to the upper surfaces of the third space chamber 103 and the sixth space chamber 106. The top plate 12 closes the upper surfaces of the other space chambers 101, 102, 104 and 105, and is attached to the top 9 of the discharge path-defining member 5 such that its peripheral edge contacts the inner surface of the bulb 1 and a seventh space 107 is formed on the upper side thereof. A pair of electrodes **15*a* and 15*b* are studded on the stem 14 attached to the bottom of the bulb 1, at places facing the first space chamber 101 and the fourth space chamber 104**.

In the thus constructed low-pressure mercury vapor discharge lamp, with electrode **15*a* in the first space chamber 101 as a cathode and the other electrode 15*b* in the fourth space chamber 104 as an anode, the discharge path is formed as illustrated in FIG. 8. The discharge path $A_3$ which passes through the upper discharge guide hole 10 of wings 81 to 86 is indicated by a solid arrow, the discharge path $A_2$ passing through the lower discharge guide hole 11 is shown by a dotted arrow, and the discharge path $A_1$ passing over the top plate 12 is represented by a double solid arrow. Discharge path $A_3$ starts from the electrode 15*a*, the cathode, and runs through the upper discharge guide hole 10 of the first wing 81, the lower discharge guide hole 11 of the second wing 82, the cut-away portion 13 of the top plate 12 via the third space chamber 103, and then reaches the sixth space chamber 106 via the seventh space chamber 107. The discharge path then runs through the lower discharge guide hole 11 of the fifth wing 85, to the fifth space chamber 105, and reaches another electrode 15*b*, the anode, through the upper discharge guide hole 10 of the fourth wing 84**.

With the discharge lamp of this embodiment, therefore, the output of light in the top portion of the bulb can be increased without decreasing the output of light in the side portions of the bulb as in the above-mentioned first embodiment. Further, since the electrodes **15*a* and 15*b* are disposed at opposing positions in the bulb 1, discharge leakage can be minimized through the portions where the edges of the wings 81 to 86 contact the inner surface of the bulb 1**. In addition to these effects, the discharge path can be lengthened to enhance the lamp efficiency (1m/W).

Figure 9:
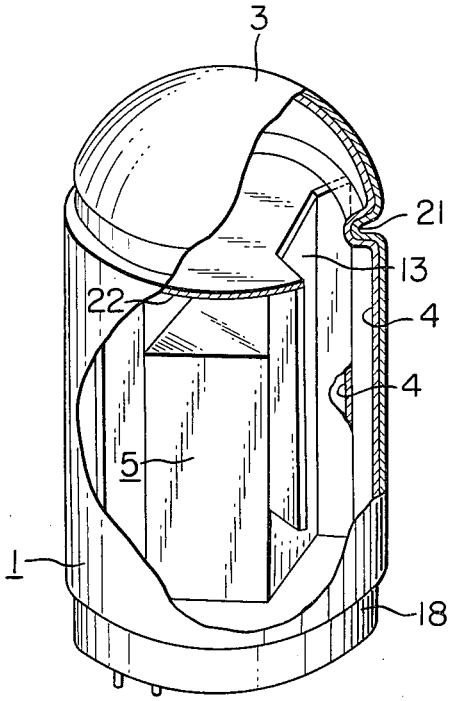
FIG. 9 is a partly cut-away perspective view of an emboditment of the discharge lamp of the invention in which a projection is formed in the bulb; according to the embodiment of the present invention.
Figure 10:
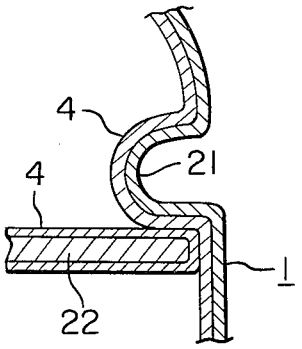
FIG. 10 is a sectional view showing a portion of FIG. 9 on an enlarged scale.

FIGS. 9 and 10 illustrate a third embodiment of the present invention, in which a projection inwardly protrudes along the entire periphery in the top portion 3 of the bulb 1. A discharge path-defining member 5 is constructed in the same manner as the above-mentioned first embodiment, with a top plate 12 attached to the upper end thereof. The top plate 12 has cut-away portions 13 for guiding the discharge, and portions 22 that contact the bulb 1. When inserted into the bulb 1, the upper surfaces of the portions 22 contact the lower surface of the projection 21. Other portions are constructed in the same manner as in the first embodiment.

In the fluorescent lamp of this embodiment, the projection 21 of the bulb 1 covers the upper surface of the portions 22 of the top plate 12 which is attached to the discharge path-defining member 5. Therefore, even if a gap is formed between the portions 22 and the inner surface of the bulb 1 due to eccentricity of the bulb 1, the projection 21 closes the gap, preventing discharge therethrough. Further, the projection 21 covers the upper edge of the top plate 12, and also determines the positioning, allowing greater tolerance of eccentricity of the bulb 1 and for the dimensional precision of the top plate 12. The projection 21 further makes insertion of the discharge path-defining member 5 into the bulb relatively easy.

The projection 21 of the bulb 1 need not necessarily be formed throughout the entire inner circumference of the bulb as in the above embodiment, but may be formed so as to cover at least the upper surface of the portions 13 of the top plate 12 that contact the inner walls of the bulb.

Figure 11:
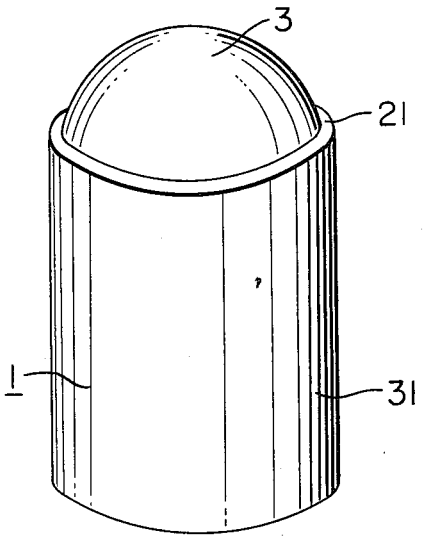
FIG. 11 is a perspective view showing a modified example of FIG. 10.

FIG. 11 shows a bulb 1 with a dome-shaped top portion 3 and a jaw-like flat portion at the lower periphery of the top portion 3 with a cylindrical drum portion 31 continuous with the flat portion. That is, the flat portion serves the function of the aforementioned projection 21, and the drum portion 31 on the lower side of the projection 21 has a diameter greater than the diameter of the top portion 3 which is located on the upper side of the projection. The bulb of this construction exhibits the same effects as the bulb illustrated in FIGS. 9 and 10, and further has an attractive appearance.

Figure 12:
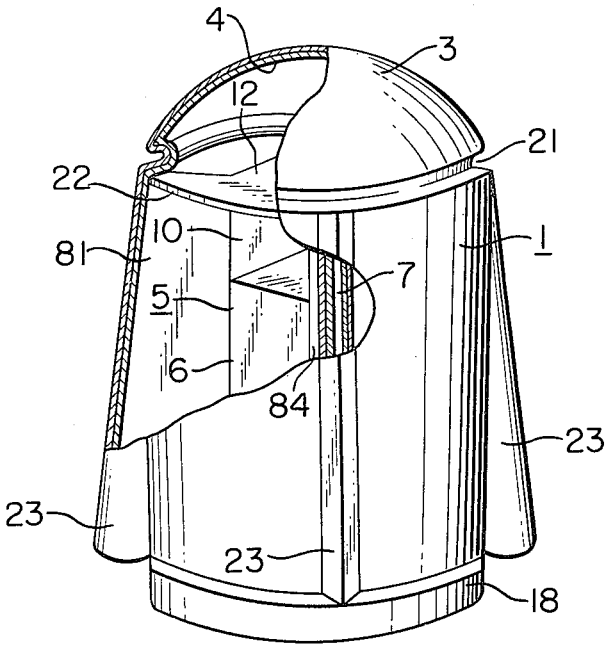
FIG. 12 is a partly cut-away perspective view illustrating an embodiment in which a projection and engaging grooves are formed in the bulb.

Below a fourth embodiment is described in conjunction with FIGS. 12 and 13, in which like reference numerals denote like or corresponding parts. A projection 21 protrudes inwardly of the bulb 1 throughout the entire inner periphery in an upper portion thereof, and four engaging grooves 23 protruding outwardly of the bulb are formed starting from the lower surface of the projection 21 toward the lower end of the bulb 1 in such a manner that their depth gradually increases toward the lower end. A discharge path-defining member 5 in which the upper surfaces of the portions 22 of the top plate 12 are brought into contact with the lower surface of the projection 21, in which the overall width is gradually increased toward the lower end to correspond to the depth of the engaging grooves 23, and in which the side portions 7 are intimately engaged with the grooves 23 such that the top plate 12 is brought into contact with the projection 21, is provided internally of the bulb 1. Other portions of the bulb accordingly to this embodiment are constructed in the same manner as those of FIG. 4.

In the fluorescent lamp of this embodiment, the internal projection 21 of the bulb 1 covers the upper surface of the portions 22 of the top plate 12 and, hence, effects similar to those of the third embodiment are exhibited. Further, since the engaging grooves 23 and the side portions 7 of the discharge path-defining member 5 are inclined in a corresponding manner, the insertion of the discharge path-defining member 5 into the bulb 1 is complete when the lower ends of the side portions 7 of the discharge path-defining member 5 are brought into contact with the bottom surface of the engaging grooves 23. Further, since the side portions 7 of the discharge path-defining member do not advance in contact with the fluorescent layer 4 on the surface of the engaging grooves 23, the fluorescent layer 4 is prevented from being peeled off by the passage of the discharge-defining member 5. The side portions 7 of the discharge path-defining member engage the engaging grooves 23 and are embraced thereby. Therefore, the engaging portions have high discharge resistance, and reduce discharge leakage. Therefore, the width of the side portions 7 can be reduced so that any shadow caused by the discharge path-defining member 5 is not a practical problem. Moreover, since the engaging grooves 23 protrude beyond the bulb 1 and have a large curvature, the shadow caused by the discharge path-defining member 5 can be further reduced.

Figure 13:
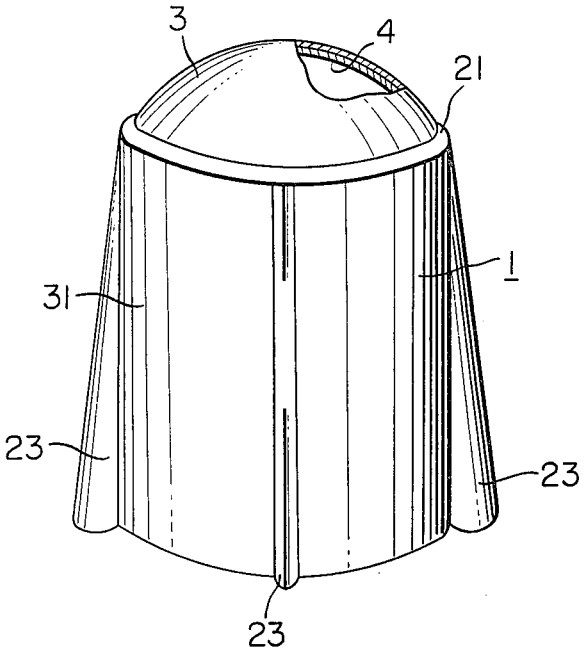
FIG. 13 is a partly cut-away perspective view showing a modified example of FIG. 12.

FIG. 13 shows a bulb 1 with a dome-shaped top portion 3 and a jaw-like flat portion at the lower periphery of the top portion 3 with a cylindrical drum portion 31 contiguous with the flat portion, the drum portion 31 having engaging grooves 23 whose depth gradually increases toward the bottom of the bulb. That is, the flat portion serves as a projection 21, and the drum portion 31 on the lower side of the projection 21 has a diameter greater than the diameter of the top portion 3 which is located on the upper side of the projection. The bulb of this construction exhibits the same effects as those of the above-mentioned embodiments, and further has an attractive appearance.

Figure 14:
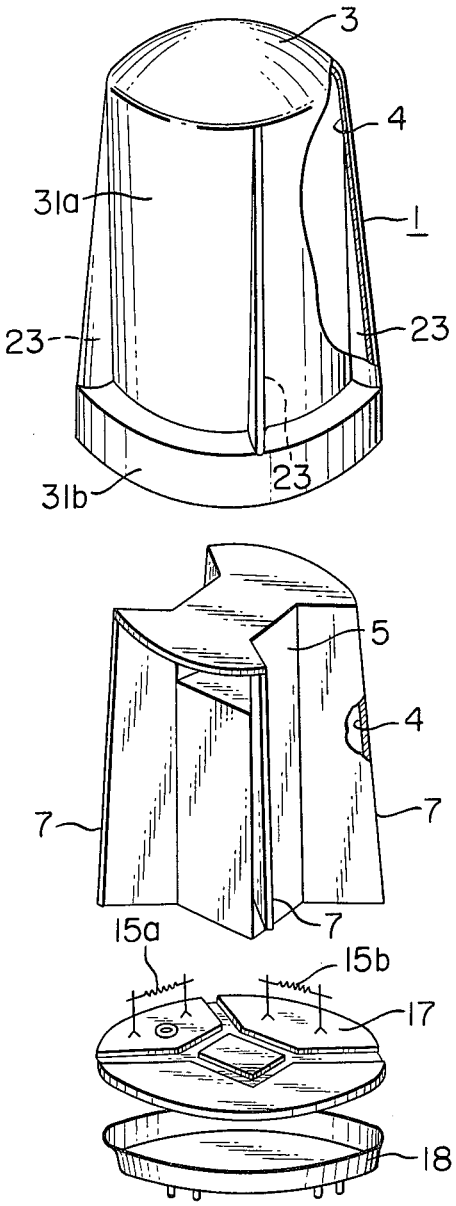
FIG. 14 is a partly cut-away exploded perspective view showing an embodiment in which the bulb consists of a small-diameter portion and a large-diameter portion, and engaging grooves are formed in the small-diameter portion.

Below a fifth embodiment is described with reference to FIG. 14, in which like reference numerals denote like or corresponding parts. A glass bulb 1 consists of a dome-shaped cylindrical small-diameter drum portion **31*a* forming a top portion 3, and a large-diameter drum portion 31*b* which is contiguous with the lower end of the small-diameter drum portion 31*a* and has a diameter larger than the diameter of the small-diameter drum portion 31*a*. Engaging grooves 23 engage with the side portions 7 of the discharge path-defining member 5. Grooves 23 are open at opposing positions on the outer side of the small-diameter drum portion 31*a* running in the upper and lower directions,and have a depth which gradually decreases toward the top portion 3 of the bulb, and lower ends which are open toward the inner side of the large-diameter drum portion 31*b*. A discharge path-defining member 5 of which the side portions 7 are fitted into the engaging grooves 23 and which is constructed in the same manner as the similar member in FIG. 4, is provided inside the bulb, and a glass stem of which the upper surface is brought into contact with the lower surface of the discharge path-defining member 5, and of which the side surface is adhered onto the large-diameter drum portion 31*b*** is also provided.

In a fluorescent lamp thus constructed according to this embodiment, the bulb 1 consists of a small-diameter drum portion **31*a* having engaging grooves 23, and a large-diameter drum portion 31*b* which has a diameter larger than that of the small-diameter drum portion 31*a* but which does not have engaging grooves 23. Further, since the stem 17 is attached to the large-diameter drum portion 31*b*, the fluorescent layer 4 can be prevented from being peeled off by the passage of the discharge path-defining member 5, the leakage of discharge can be prevented, and the shadow caused by the discharge path-defining member 5 can be reduced. In addition to these effects, the large-diameter drum portion 31*b* having a uniform thickness, can be heated and melted evenly so that it is easily melt-adhered to the stem without causing the bulb 1 and the stem 17** to be deformed.

What is claimed is:

1. A discharge lamp comprising:

a bulb made of a light-transmitting material, including a fluorescent layer formed on the inner surface thereof and which contains a mercury gas and a rare gas, said bulb having a longitudinal axis which extends from the top to the bottom of said bulb;

a pair of electrodes provided in said bottom of said bulb;

a discharge path-defining member disposed in said bulb and shaped so as to define a discharge path between said electrodes which is convoluted along the axial direction of said bulb; and a top plate attached to an end of said discharge-defining member and defining an independent discharge space thereabove at the top of said bulb, so that a portion of said discharge path extends through said discharge space across the center of said top plate, said discharge path-defining member including radially extending wings having outer peripheral edges, said bulb having engaging grooves that engage said outer peripheral edges of said wings.

2. A discharge lamp as set forth in claim 1, wherein the depth of the engaging grooves formed in the bulb gradually decreases toward said top of the bulb.

3. A discharge lamp as set forth in claim 2, wherein said outer peripheral edges of said wings of said discharge path-defining member are formed so as to correspond to the shapes of the engaging grooves that they contact.

4. A discharge lamp as in claim 1, wherein said discharge path-defining member and said top plate have outer surfaces, a layer of fluorescent material being formed on each of said outer surfaces.

5. A discharge lamp as in claim 1, wherein said bulb has an internal peripheral projection that contacts and covers the peripheral portions of the upper surface of said top plate.

6. A discharge lamp comprising:

a bulb made of a light-transmitting material including a fluorescent layer formed on the inner surface thereof and which contains a mercury gas and a rare gas, said bulb having a longitudinal axis extending from the top to the bottom of said bulb;

a first electrode and a second electrode provided in the bottom of said bulb;

a discharge path-defining member disposed in said bulb and shaped so as to define a descharge path between said first and second electrodes which is convoluted along the axial direction of said bulb; and a top plate attached to an end of said discharge path-defining member and defining an independent discharge space thereabove at the top of said bulb, a portion of said discharge path extending through said discharge space across the center of said top plate;

said discharge path-defining member including a cylindrical core and four wings which stretch radially from said core and divide the space in said bulb into four sections spaced about said axis, said sections being so disposed as to form successive first, second, third and fourth space chambers, said first and second electrodes being respectively disposed in said first and second space chambers, an upper discharge guide hole being formed in the upper portion of said core below said top plate so as to communicate said second space chamber with said fourth space chamber, the lower discharge guide hole being formed in a lower end of one of said four wings to communicate said third space chamber with said fourth space chamber, said top plate having first and second cut-away portions that respectively face said first space chamber and said third space chamber.

7. A discharge lamp as in claim 6, wherein said core and said four wings have outwardly facing surfaces parabolic in horizontal cross section.

8. A discharge lamp as in claim 6, further comprising a layer of fluorescent material formed on the surface of said discharge path-defining member and on the upper surface of said top plate.

9. A discharge lamp as in claim 6, wherein said bulb has an internal peripheral projection that contacts and covers the peripheral portion of the upper surface of said top plate.

10. A discharge lamp as in claim 6, wherein said bulb has engaging grooves that engage the outer peripheral edges of said four wings of said discharge path-defining member.

11. A discharge lamp comprising:

a bulb made of a light-transmitting material including a flourescent layer formed on the inner surface thereof and which contains a mercury gas and a rare gas, said bulb having a longitudinal axis extending from the top to the bottom of said bulb;

a first electrode and a second electrode, provided in the bottom of said bulb;

a discharge path-defining member disposed in said bulb and so shaped as to define a discharge path between said first and second electrodes, said discharge path being convoluted along the axial direction of said bulb; and a top plate attached to an end of said discharge path-defining member and defining an independent discharge space thereabove at said top of said bulb, a portion of said discharge path extending through said discharge space across the center of said top plate;

said discharge path-defining member including a core and six wings which stretch radially from said core and which divide the space in said bulb into six sections spaced about said axis, said sections being so arrayed as to form successive first, second, third, fourth, fifth and sixth space chambers, said first and second electrodes being respectively in said first space chamber and in said fourth space chamber, a first upper discharge guide hole being formed in the top portion of the wing which separates said first space chamber and said second space chamber and a second upper discharge guide hole being formed in the wing which separates said fourth space chamber from said fifth space chamber, and a first lower discharge guide hole being formed in the lower portion of the wing which separates said second space chamber from said third space chamber and a second lower discharge guide hole being formed in the lower portion of the wing that separates said fifth space chamber and said sixth space chamber, such that adjacent ones of said first, second, third, fourth, fifth and sixth space chambers respectively communicate with each other, said top plate having first and second cut-away portions that respectively face said third space chamber and said sixth space chamber, said bulb having an internal peripheral projection that contacts and covers the peripheral portion of the upper surface of said top plate.

12. A discharge lamp as in claim 11, further comprising a layer of fluorescent material formed on the outer surface of said discharge path-defining member and on the upper surface of said top plate.

13. A discharge lamp as in claim 11, wherein said bulb has engaging grooves that engage the outer peripheral edges of said six wings of said discharge path-defining member.

14. A discharge lamp comprising:

a bulb made of a light-transmitting material, including a fluorescent layer formed on the inner surface thereof and which contains a mercury gas and a rare gas, said bulb having a longitudinal axis which extends from the top to the bottom of said bulb;

a pair of electrodes provided in said bottom of said bulb;

a discharge path-defining member disposed in said bulb and shaped so as to define a discharge path between said electrodes which is convoluted along the axial direction of said bulb; and a top plate attached to an end of said discharge-defining member and defining an independent discharge space thereabove at the top of said bulb, so that a portion of said discharge path extends through said discharge space across the center of said top plate, said bulb having an internal peripheral projection that contacts and covers the peripheral portions of the upper surface of said top plate.

15. A discharge lamp comprising:

a bulb made of a light-transmitting material including a flourescent layer formed on the inner surface thereof and which contains a mercury gas and a rare gas, said bulb having a longitudinal axis extending from the top to the bottom of said bulb;

a first electrode and a second electrode, provided in the bottom of said bulb;

a discharge path-defining member disposed in said bulb and so shaped as to define a discharge path between said first and second electrodes, said discharge path being convoluted along the axial direction of said bulb; and a top plate attached to an end of said discharge path-defining member and defining an independent discharge space thereabove at said top of said bulb, a portion of said discharge path extending through said discharge space across the center of said top plate;

said discharge path-defining member including a core and six wings which stretch radially from said core and which divide the space in said bulb into six sections spaced about said axis, said sections being so arrayed as to form successive first, second, third, fourth, fifth and sixth space chambers, said first and second electrodes being respectively in said first space chamber and in said fourth space chamber, a first upper discharge guide hole being formed in the top portion of the wing which separates said first space chamber and said second space chamber and a second upper discharge guide hole being formed in the wing which separates said fourth space chamber from said fifth space chamber, and a first lower discharge guide hole being formed in the lower portion of the wing which separates said second space chamber from said third space chamber and a second lower discharge guide hole being formed in the lower portion of the wing that separates said fifth space chamber and said sixth space chamber, such that adjacent ones of said first, second, third, fourth, fifth and sixth space chambers respectively communicate with each other, said top plate having first and second cut-away portions that respectively face said third space chamber and said sixth space chamber, said bulb having engaging grooves that engage the outer peripheral edges of said six wings of said discharge path-defining member.

* * * * *